US005417761A

United States Patent [19]

Bernert

[11] Patent Number: 5,417,761

[45] Date of Patent: May 23, 1995

[54] DOCTOR BLADE HOLDING APPARATUS

[75] Inventor: Richard Bernert, Giengen, Germany

[73] Assignee: J.M. Voith GmbH, Heidenheim, Germany

[21] Appl. No.: 209,549

[22] Filed: Mar. 10, 1994

[30] Foreign Application Priority Data

Mar. 16, 1993 [DE] Germany ..... 43 08 302.1

[51] Int. Cl.[6] ..... B05C 21/00

[52] U.S. Cl. ..... 118/110; 15/256.51; 15/256.52; 118/118; 118/203; 118/413; 118/414

[58] Field of Search ..... 118/110, 118, 70, 104, 118/203, 410, 413, 414; 162/281; 15/256.51, 256.52; 101/350, 363; 427/359, 361

[56] References Cited

U.S. PATENT DOCUMENTS

| | | | |
|---|---|---|---|
| 3,143,438 | 8/1964 | Campbell | 118/104 |
| 3,559,572 | 2/1971 | Hackley | 118/118 |
| 3,683,851 | 8/1972 | Nolden | 118/126 |
| 4,282,826 | 8/1981 | Wohlfeil | 118/118 |
| 4,658,753 | 4/1987 | Eklund | 118/118 |
| 4,773,351 | 9/1988 | Sollinger | 118/118 |
| 5,122,396 | 6/1992 | Rantanen | 15/256.52 |

*Primary Examiner*—W. Gary Jones
*Assistant Examiner*—Laura E. Edwards
*Attorney, Agent, or Firm*—Marshall, O'Toole, Gerstein, Murray & Borun

[57] ABSTRACT

A doctor blade holding apparatus, preferably for coating devices, includes a clamping mechanism which holds, via a mounting plate, a doctor blade support which carries a doctor rod. The apparatus includes a pressing tube which presses against the doctor blade support and thus presses the doctor rod against a counter roll. A holding strip provided at a back side of the doctor blade support clamps the mounting plate to the doctor blade support. The holding strip is disposed laterally with respect to a mid-plane of the doctor blade support to provide a contact region between a back side of the doctor blade support and the pressing tube which is in substantially the same plane as the mounting plate.

4 Claims, 1 Drawing Sheet

DOCTOR BLADE HOLDING APPARATUS

BACKGROUND OF THE INVENTION

1. Field of the Invention

The invention relates to holding devices and in particular to an apparatus for holding a tool, such as a doctor blade, utilized to regulate the coating thickness in the coating of a web of material.

2. Description of Related Technology

A doctor blade holding apparatus disclosed in DE 20 08 082 (corresponding to Nolden, U.S. Pat. No. 3,683,851 (Aug. 15, 1972)) includes a clamping mechanism for holding a mounting plate, a doctor blade support attached to the mounting plate and a doctor blade or rod (identified as a round rod scraper in U.S. Pat. No. 3,683,851) mounted on the doctor blade support. A pressing tube exerts pressure on the doctor blade support which in turn presses the doctor rod onto a web of material wrapped onto a counter roll of a coating machine. The mounting plate of such a device is typically in the form of a leaf spring.

Process requirements may compel the replacement of the doctor blade support and the doctor rod with a coating blade, which is also typically in the form of a leaf spring. It would be desirable to replace a doctor rod with a coating blade without extensive rebuilding of the apparatus. However, this is made very difficult in some embodiments of the known device according to DE 20 08 082 where the doctor blade support is vulcanized onto the mounting plate.

However, it has become a customary practice to use doctor blade supports which have a holding strip attached to them. The holding strip secures the doctor blade support to the mounting plate. As a result, the doctor blade support can be replaced easily without having to discard the mounting plate. However, even in such embodiments, it is almost impossible to replace the doctor blade support, together with the doctor rod and the mounting plate by a coating blade without significant rebuilding of the apparatus.

SUMMARY OF THE INVENTION

It is an object of the invention to overcome one or more of the problems described above. It is also an object of the invention to provide an apparatus wherein a mounting plate and a coating blade may be alternatively clamped in the same clamping mechanism.

A doctor blade holding apparatus according to the invention includes a clamping mechanism for holding a mounting plate, a doctor blade support mounted on the mounting plate and a doctor rod mounted on the doctor blade support. The apparatus includes a pressing tube which exerts pressure on the doctor blade support which in turn presses the doctor rod onto a counter roll. A holding strip disposed at a back side of the doctor blade support secures the doctor blade support to the mounting plate. The holding strip is disposed laterally with respect to a mid-plane of the doctor blade to provide a pressing surface between the doctor blade back side and the pressing tube which is disposed substantially in the same plane as the mounting plate.

Other objects and advantages of the invention will be apparent to those skilled in the art from the following detailed description taken in conjunction with the drawings and the appended claims.

DETAILED DESCRIPTION OF THE INVENTION

Figure 1:
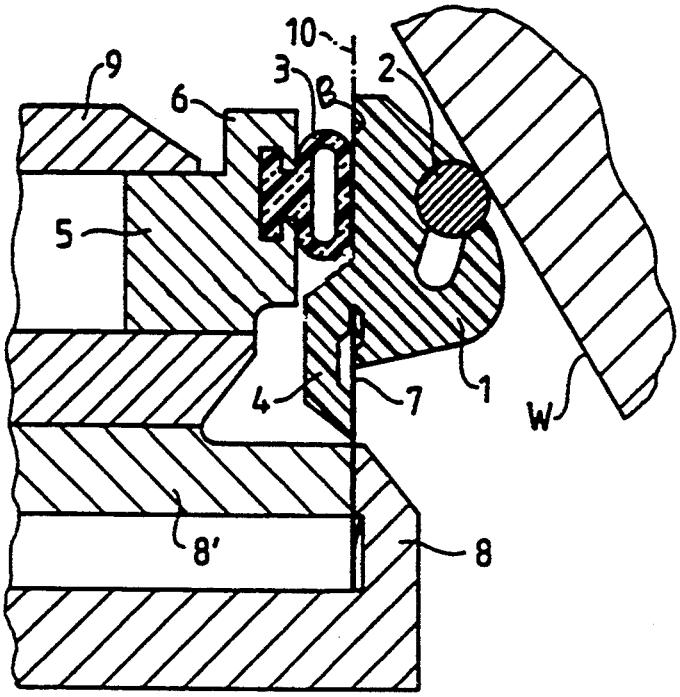
FIG. 1 is a partially schematic sectional view of an apparatus according to the invention.

A doctor blade holding apparatus according to the invention is shown in FIG. 1, wherein a doctor blade support 1 is disposed in a lower quadrant of a counter roll W of a coating machine (not shown). In the embodiments shown in FIGS. 1 and 2, a doctor rod 2 (also known as a rod scraper or smoothing bar) is mounted on the doctor blade support 1, in place of a traditional doctor blade. The doctor blade support 1 and the doctor rod 2 are directed toward the counter roll W by a pressing tube 3 and a thrust piece 5, thereby pressing the doctor rod 2 against the counter roll W. The thrust piece 5 is disposed substantially horizontally in a guide 9. The pressing tube 3 is held in an extension member 6 of the thrust piece 5.

The doctor blade support 1 includes a holding strip 4, which extends from the support 1 and is integral thereto. A leaf-spring-like mounting plate 7 is clamped to the doctor blade support 1 by the holding strip 4, the mounting plate 7 frictionally engaging both the support 1 and the holding strip 4. The strip 4 extends from a back side B of the doctor blade support 1 which contacts the pressing tube 3 and is disposed opposite a side onto which the doctor rod 2 is mounted. The mounting plate 7 is disposed between the strip 4 and the doctor blade support 1 such that the back side B of the support 1 and the mounting plate 7 are disposed in substantially the same plane. The mounting plate 7 is also clamped between a holder 8 and a holder bar 8' (also referred to herein as a clamping mechanism 8, 8').

If the doctor blade support 1 is replaced by a coating blade 10 (shown in phantom lines in FIG. 1), the coating blade 10 is disposed in substantially the same plane as the mounting plate 7. A slight swiveling movement of the doctor blade holding apparatus (produced by moving the thrust piece 5 and thus the pressing tube 3 against the coating blade 10) is sufficient to move the coating blade 10 into contact with the counter roll W. Thus, the apparatus according to the invention advantageously allows replacement of the doctor blade support 1 by a coating blade 10 without rebuilding the apparatus.

The region of contact between the pressing tube 3 and the doctor blade support 1 is off-center (i.e. disposed substantially laterally) with respect to a substantially horizontal plane running through the middle of the thrust piece 5, By offsetting or displacing the region of contact in this fashion, a suitable contact region between the pressing tube 3 and the coating blade 10 is also obtained when the doctor blade support 1 is replaced with the coating blade 10. Such a displacement of the contact region between the pressing tube 3 and the doctor blade support 1 does not bring about any significant disadvantages with respect to the relationship between the pressing tube 3 and the doctor rod 2. To provide space for the contact line between the pressing tube 3 and the doctor blade support 1, the holding strip 4 is also disposed off-center (i.e. positioned laterally) with respect to a substantially horizontal plane running through the doctor blade support 1.

Figure 2:
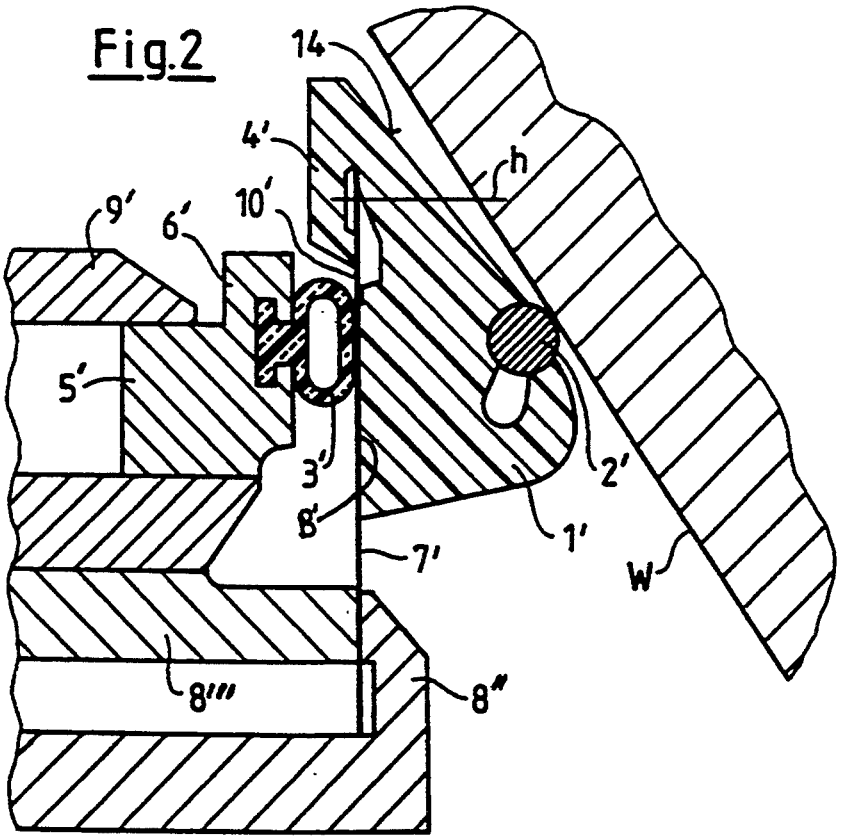
FIG. 2 is a partially schematic sectional view of a second embodiment of an apparatus according to the invention.

A second embodiment of a doctor blade holding apparatus according to the invention is shown in FIG. 2. The elements designated by reference numerals 2', 3', 5', 6', 8'', 8''', 9', and 10' are identical to the elements 2, 3, 5, 6, 8, 8', 9, and 10, respectively, described herein with respect to FIG. 1. The elements designated by reference numerals 1', 4', 7' function in the same way as the elements designated by reference numerals 1, 4 and 7 described with respect to FIG. 1. The embodiment shown in FIG. 2 is therefore substantially similar to the embodiment shown in FIG. 1 with the exception of the location of the holding strip 4' which is disposed near an end region of the doctor blade support 1' having an inclined surface 14. The holding strip 4' is thus laterally disposed with respect to a substantially horizontal mid-plane of the doctor blade support 1' opposite of the location of the holding strip 4 shown in FIG. 1. When a coating blade 10' is placed into the apparatus and clamped in the clamping mechanism 8'', 8''', the blade terminates at its upper end at a height h.

The inclined surface 14 is on a front side of the doctor blade support 1' facing the counter roll W. The inclination of the surface 14, which may also be arched (i.e. forms a chord) is at an angle of between about 45° and about 55° with respect to a plane defined by a center axis of the doctor rod 2' and a center axis of the pressing tube 3'.

With respect to both FIGS. 1 and 2, the doctor blade holding apparatus is preferably disposed at an angle between about 20° and about 60° measured from a foot of the roll W (i.e, the apparatus is disposed in the lower quadrant of a cross-section of the roll W). The doctor blade support 1 or 1' has sufficient room between the thrust piece 3 or 3' and the clamping mechanism 8, 8' or 8'', 8''' and the roll W. When the doctor blade support is replaced by a coating blade 10 or 10', more than adequate space is provided because the coating blade is narrow.

The foregoing detailed description is given for clearness of understanding only, an no unnecessary limitations should be understood therefrom, as modifications within the scope of the invention will be apparent to those skilled in the art.

I claim:

1. In a doctor blade holding apparatus having a clamping mechanism for holding a mounting plate, a doctor blade support mounted on the mounting plate, a doctor rod mounted on the doctor blade support, a pressing tube to exert pressure on the doctor blade support which in turn presses the doctor rod against a counter roll, and a holding strip disposed at a back side of the doctor blade support, said strip clamping the doctor blade support to the mounting plate, the improvement wherein the holding strip is disposed laterally of a mid-plane of the doctor blade support providing a contact region between the back side of the doctor blade support and the pressing tube wherein said contact region is disposed in substantially the same plane as the mounting plate.

2. The improvement of claim 1 wherein the doctor blade support includes an inclined front surface spaced from the doctor rod and facing in a direction opposite the clamping mechanism, the front surface disposed at an angle of between about 45° and about 55° with respect to a plane defined by a center axis of the doctor rod and a center axis of the pressing tube, and wherein the holding strip is disposed near the front surface and opposite the clamping mechanism.

3. The improvement of claim 1 wherein the holding strip projects from the doctor blade support in a direction toward the clamping mechanism and is disposed adjacent the clamping mechanism.

4. The improvement of claim 1 wherein the apparatus is disposed at an angle of between about 20° and about 60° with respect to a foot of the counter roll.

* * * * *